US009228305B2

(12) United States Patent
Stratford

(10) Patent No.: US 9,228,305 B2
(45) Date of Patent: Jan. 5, 2016

(54) BOLLARD

(71) Applicant: McCue International Inc, Buckinghamshire (GB)

(72) Inventor: Timothy D. Stratford, Buckinghamshire (GB)

(73) Assignee: MCCUE INTERNATIONAL INC., Buckinghamshire (GB)

( * ) Notice: Subject to any disclaimer, the term of this patent is extended or adjusted under 35 U.S.C. 154(b) by 30 days.

(21) Appl. No.: 14/078,600

(22) Filed: Nov. 13, 2013

(65) Prior Publication Data

US 2014/0140764 A1 May 22, 2014

(30) Foreign Application Priority Data

Nov. 15, 2012 (GB) ..... 1220541.5

(51) Int. Cl.
*E01F 15/00* (2006.01)
*E01F 9/017* (2006.01)
*E01F 15/14* (2006.01)

(52) U.S. Cl.
CPC ..... *E01F 15/00* (2013.01); *E01F 9/0175* (2013.01); *E01F 15/141* (2013.01)

(58) Field of Classification Search
CPC ..... E01F 13/12; E01F 13/026; E01F 15/00; E01F 15/0461; E01F 15/141; E01F 9/175; E01F 9/011; E01F 9/017; E01F 13/00
USPC ..... 404/6, 9, 10
See application file for complete search history.

(56) References Cited

U.S. PATENT DOCUMENTS

| | | | | | |
|---|---|---|---|---|---|
| 4,486,117 | A * | 12/1984 | Blau | 404/10 |
| 4,636,108 | A * | 1/1987 | Duckett | 404/10 |
| 5,004,366 | A * | 4/1991 | Simmons | 403/2 |
| 5,323,583 | A * | 6/1994 | Venegas, Jr. | 52/309.4 |
| 5,503,496 | A * | 4/1996 | Voigt | 404/10 |
| 5,809,733 | A * | 9/1998 | Venegas, Jr. | 52/835 |
| 6,149,340 | A * | 11/2000 | Pateman | 404/10 |
| 6,209,276 | B1 * | 4/2001 | Venegas, Jr. | 52/301 |
| 6,213,452 | B1 * | 4/2001 | Pettit et al. | 256/59 |
| 7,901,156 | B2 * | 3/2011 | McCue et al. | 404/9 |
| 8,444,343 | B2 * | 5/2013 | McCue et al. | 404/9 |
| 2002/0056251 | A1 * | 5/2002 | Venegas, Jr. | 52/736.3 |
| 2007/0110515 | A1 * | 5/2007 | Appelman | 404/6 |

FOREIGN PATENT DOCUMENTS

| | | |
|---|---|---|
| GB | 2461206 | 11/2012 |
| KR | 100767592 | 10/2007 |
| KR | 20110083845 | 7/2011 |

* cited by examiner

*Primary Examiner* — Abigail A Risic
(74) *Attorney, Agent, or Firm* — Occhiuti & Rohlicek LLP

(57) ABSTRACT

A bollard comprises an elongate outer tubular cover, an elongate inner tubular core located within the outer tubular cover, a damper located at a lower end of the inner tubular core, and a washer arranged to locate the damper against the inner tubular core. The outer tubular cover and the inner tubular core are both substantially circular in horizontal cross-section and the outer tubular cover and the inner tubular core are not connected together. The bollard further comprises one or more bolts, each bolt passing through the washer, damper and inner tubular core and into the ground.

22 Claims, 6 Drawing Sheets

BOLLARD

CROSS-REFERENCE TO RELATED APPLICATIONS

Under 35 USC 119, this application claims the benefit of the priority date of U.K. Application No. 1220541.5, filed on Nov. 15, 2012, the content of which is herein incorporated by reference.

FIELD OF DISCLOSURE

This invention relates to a bollard and to a method of fixing the bollard to the ground.

BACKGROUND

In supermarkets and retail stores, objects such as freezers refrigerators, shelving and product displays are susceptible to damage due to collisions with items such as shopping trolleys, floor scrubbers and pallet jacks. For example, freezer and refrigerator cases typically include a glass or transparent plastic door for viewing the products inside without opening the door. The glass can be shattered or the plastic scratched, upon impact with shopping trolleys. Since the body of many of these floor fixtures is constructed of lightweight metals or hardened plastic it can be easily dented or cracked by such impacts. Likewise, in industrial locations such as warehouses and manufacturing facilities, both internally and externally, product storage, doorways and equipment are susceptible to damage due to collisions with heavy equipment, such as delivery vehicles and forklifts.

A bollard protects objects and fixtures from collisions with all types of vehicles. Bollards are commonly employed inside a store to protect store fixtures and outside a store to protect outdoor structures from collisions, to indicate parking areas, to block vehicle and heavy equipment access to a particular area, and to direct flow of traffic. Bollards can also be used to block vehicular access for security reasons.

There are two primary types of bollards; plate-mounted bollards and core-drilled bollards. Plate-mounted bollards conventionally involve a steel plate having three or four bolt holes and a bollard extending perpendicularly from one face of the plate. The plate sits on the floor and bolts are used to fasten the plate, and therefore the bollard, to the floor through the bolt holes. There is no significant disruption to the ground or floor, other than the bolt holes, which are in some instances pre-drilled. On the other hand, core-drilled bollards conventionally require a major disruption to the ground or floor with the creation of a hole two to four feet deep and having a larger diameter than the bollard itself, for example eight inches to two feet, or larger. Concrete is poured into the hole and the bollard is placed in the concrete and held vertically while the concrete cures. In some instances, concrete is also poured into the hollow bollard itself. Installation of a core-drilled bollard is significantly more expensive than with a plate-mounted bollard, and takes significantly more time to complete. However, there are locations where the core-drilled bollard is required due to its ability to absorb larger impacts than the plate-mounted bollard.

Plate-mounted bollards are conventionally utilised in areas where impacts are more likely to be less severe, and involve lighter objects, or where no significant impacts are likely and the bollard serves more as a marker. For example, inside a grocery store in front of a freezer case any impact would likely be from a shopping trolley or floor polisher. Such an impact would be considered to be low-energy, or relatively minor. Accordingly, a plate-mounted bollard would be appropriate for this type of installation. However, in a warehouse with heavy equipment, such as delivery vehicles and forklifts, impacts are more likely to be more severe, or high-energy. A vehicle backing up may accidentally collide with a bollard. Accordingly, a core-drilled bollard would be more appropriate in these types of settings.

There are a substantial number of installations where a conventional plate-mounted bollard does not provide quite enough impact protection; however, a core-drilled bollard is significantly over-sized for the application. Yet, a core-drilled bollard is installed because the conventional plate-mounted bollard falls short of providing the required protection. Likewise, there are installations where a core-drilled bollard is necessary to provide protection against likely impacts, yet a plate-mounted bollard is installed because they are less expensive or there are logistical problems with drilling four foot deep holes for the core-drilled bollard installation. Other factors may influence the selection of a plate-mounted bollard or a core-drilled bollard.

To address this issue, a bollard having an impact absorption mechanism is disclosed in U.S. Pat. No. 7,901,156 B2. This Patent discloses a plate-mounted bollard which includes an internal impact absorption mechanism that enables the bollard to absorb impact forces greater than conventional plate-mounted bollards. The bollard makes use of a force transfer process that shifts impact forces to areas better able to resiliently absorb the impact without causing damage to the bollard, the impact absorption mechanism, or the ground in which the bollard is installed. The impact absorption mechanism consists of an internal resilient core rod mounted at its proximal end to a base plate which is fixed to the ground. Impact forces are then transferred through an outer shell to the distal or upper end of the internal resilient core. With energy from the impact force being distributed along the maximum length of the resilient core rod, the rod flexes and the full length of the rod is utilized to absorb the impact energy.

SUMMARY

Although the bollard of this Patent is an effective solution to the provision of a plate-mounted bollard in situation where a core-drilled bollard would normally have been preferred, this bollard is relatively complex and expensive to manufacture and maintain and is not an ideal solution in all circumstances.

It is therefore an object of the invention to improve upon the known art.

According to a first aspect of the present invention, there is provided a bollard comprising an elongate outer tubular cover, an elongate inner tubular core located within the outer tubular cover, a damper located at a lower end of the inner tubular core, and a washer arranged to locate the damper against the inner tubular core, wherein the outer tubular cover and the inner tubular core are both substantially circular in horizontal cross-section and the outer tubular cover is able to rotate relative to the inner tubular core.

According to a second aspect of the present invention, there is provided a method of fixing a bollard to the ground comprising receiving an elongate outer tubular cover, an elongate inner tubular core, a damper, a washer and one or more bolts, passing the or each bolt through the washer, damper and inner tubular core and into the ground, and placing the outer tubular cover over the inner tubular core such that the outer tubular cover is able to rotate relative to the inner tubular core.

Owing to the invention, it is possible to provide a bollard that can be used as a plate-mounted bollard that will provide effective collision protection and will also disperse the energy from a low level collision, without any damage to the bollard. The outer cover and the inner core transfer collision energy to the damper within the bollard, which absorbs and disperses the energy of a collision. The bollard is relatively simple to manufacture and install and comprises a small number of relatively straightforward components. The outer tubular cover and the inner tubular core are both substantially circular in horizontal cross-section and the outer tubular cover and the inner tubular core are preferably not connected together. This form of construction of the bollard allows the outer cover to rotate relative to the inner core and this further helps to disperse the energy from a collision, as the rotation of the outer cover will absorb energy prior to any further energy being transmitted to other components within the bollard.

Advantageously, the outer tubular cover and the inner tubular core are both ground-contacting, with the inner tubular core being closed at the lower end, wherein the washer directly contacts the damper and the damper directly contacts the closed lower end of the inner tubular core. This provides the most effective arrangement of the components, with the outer cover and the inner core both grounded. The inner core is closed at the ground-contacting end with a flat plate which has the washer clamping the damper against the flat plate of the inner core.

Ideally, the inner tubular core comprises one or more spacing elements on the external surface thereof. In the preferred embodiment, each spacing element comprises a substantially horizontal ring around the inner tubular core and the inner tubular core comprises two spacing elements on the external surface thereof. The spacing elements provide two main functions, firstly in that they support the rotation of the outer cover around the inner core, during any collision, and secondly they can provide their own shock-absorbing function during a collision. The outer tubular cover can comprise one or more holes, each hole locating a fixing lug. At least one hole is located below a spacing element and the respective fixing lug extends inside the outer tubular cover in a position below the spacing element. The provision of the holes and lugs relative to the spacing elements provides a simple way of retaining the outer cover in position relative to the inner core, without there being any direct connection between these two components.

BRIEF DESCRIPTION OF THE FIGURES

Embodiments of the present invention will now be described, by way of example only, with reference to the accompanying drawings, in which.

DETAILED DESCRIPTION

Figure 1:
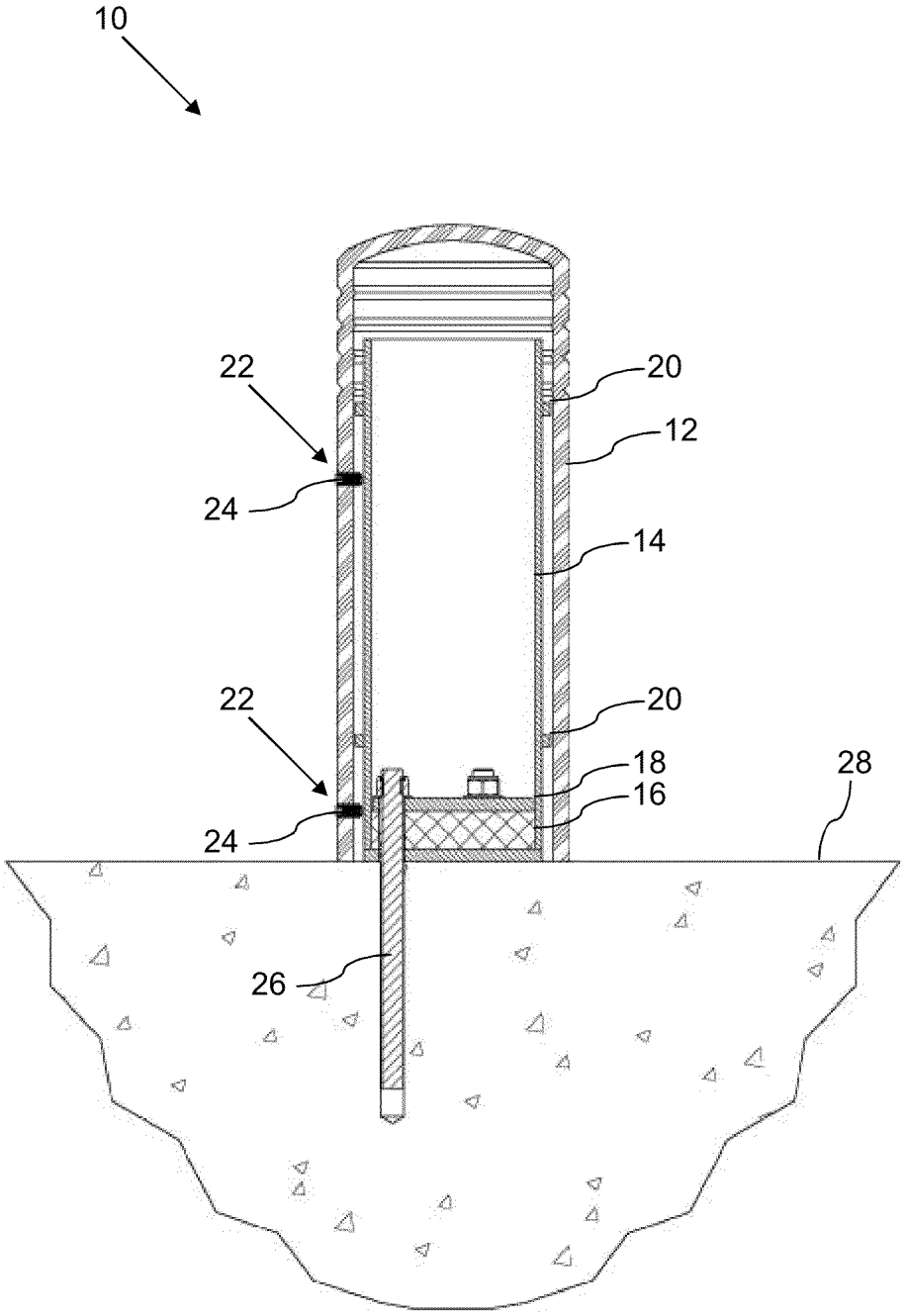
FIGS. 1 and 2 are views of a vertical section through a bollard in the ground.

FIG. 1 shows a bollard 10 in the ground 28. The Figure shows a vertical section through the bollard 10. The bollard 10 comprises an elongate outer tubular cover 12, an elongate inner tubular core 14 located within the outer tubular cover 12, a damper 16 located at a lower end of the inner tubular core 14, and a washer 18 arranged to locate the damper 16 against the inner tubular core 14. The outer tubular cover 12 and the inner tubular core 14 are both substantially circular in horizontal cross-section and the outer tubular cover 12 is able to rotate relative to the inner tubular core 14. The outer cover 12 and the inner core 14 are not connected together. The outer cover 12 and the inner core 14 are both ground-contacting.

The washer 18 directly contacts the damper 16. The inner core 14 is closed at the lower end and the damper 16 directly contacts the closed lower end of the inner core 14. The inner core 14 also comprises two spacing elements 20 on its external surface. Each spacing element 20 comprises a substantially horizontal ring around the inner core 14. The outer cover 12 has two holes 22, each hole 22 locating a fixing lug 24. Each hole 22 is located below a respective spacing element 20 and the respective fixing lug 24 extends inside the outer cover 12 towards the inner core 14 in a position below the respective spacing element 20.

The bollard further comprises three bolts 26, each bolt 26 passing through the washer 18, damper 16 and inner core 14 and into the ground 28. The bolts push together the washer 18, damper 16 and inner core 14 so that any collision energy is ultimately transferred to the damper 16 which disperses the energy from any collision. The bolts 26 anchor the bollard 10 to the ground 28 and keep the bollard 10 in position. Should any object strike the bollard 10 in a collision then the energy of that collision is directed to the damper 16 through the outer cover 12 and the inner core 14 and the energy is dispersed in this way.

Figure 2:
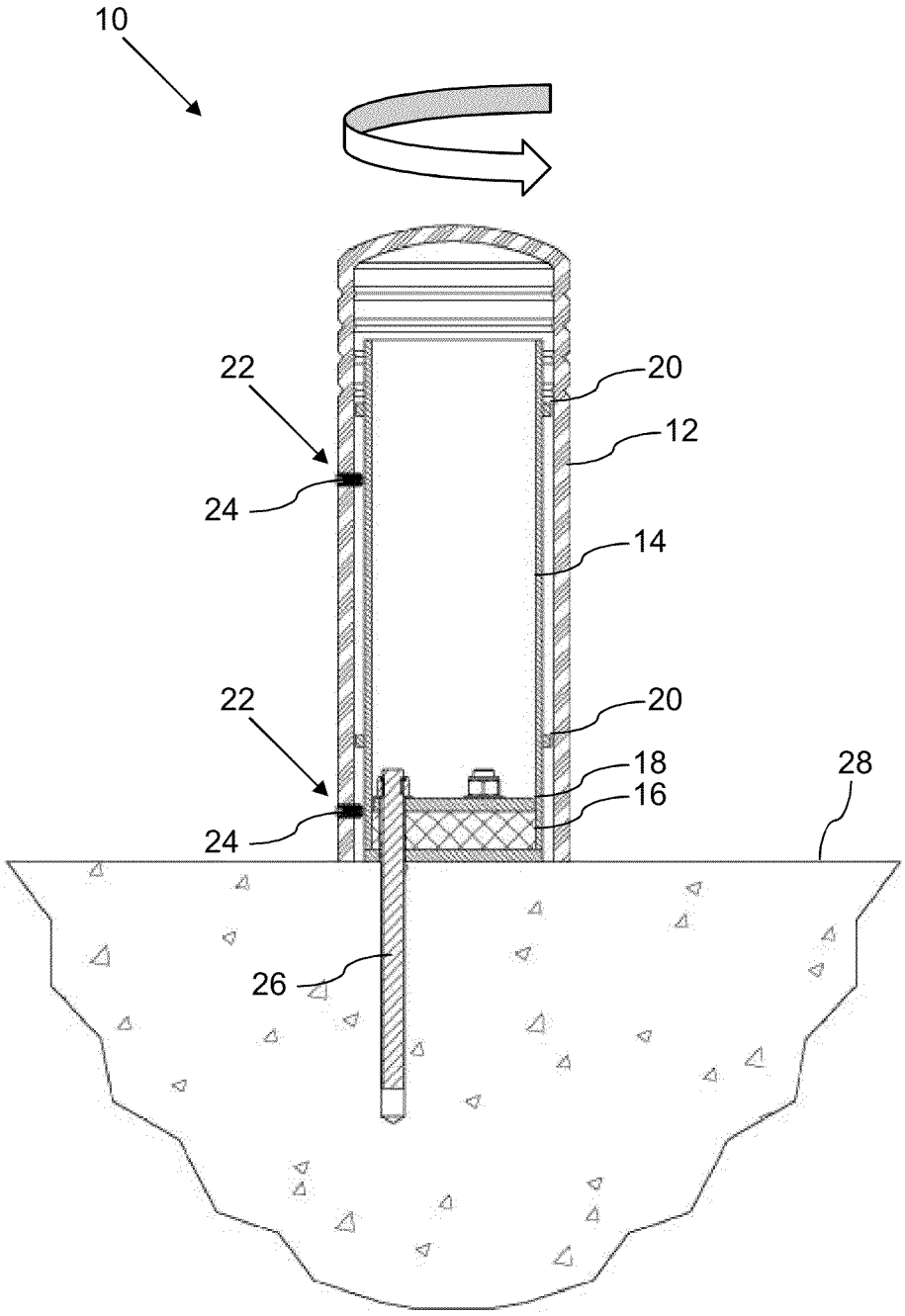

FIG. 2 shows a view similar to FIG. 1, with an arrow indicating the fact that the outer cover 12 can rotate relative to the inner core 14. Although the inner core 14 is fixed relative to the ground 28 by the bolts 26, the outer cover is not actually physically connected to the inner core 14 and is not restrained in any way. There is no connection between these two components of the bollard 10. This allows the outer cover 12 to rotate. This provides further collision damage protection, as the initial energy from any collision with the bollard 10 will be first dispersed as rotational energy, rotating the outer cover 12.

This collision protection is assisted by the spacing elements 20 that are fixed to the outside of the inner core 14. The bollard 10 is provided with two spacing elements 20 that are each formed as a ring around the inner core 14. The spacing elements 20 form part of the inner core 14 and are not fixed to the outer cover 12. The spacing elements 20 have a horizontal thickness that is slightly smaller than the gap between the outer cover 12 and the inner core 14. The spacing elements 20 are made from steel and are designed to reduce the surface contact between the outer cover 12 and the inner core 14, thus reducing the friction between the two parts thereby allowing the outer cover 12 to rotate.

The outer cover 12 is provided with two holes 22, vertically one above the other. These holes 22 receive lugs 24 that can be screwed into position. As can be seen in FIGS. 1 and 2, these lugs 24 are flush to the outer surface of the outer cover 12 but extend inwards from the outer cover 12 to touch the inner core 14. The lugs help to retain the outer cover 12 in position, while not restricting the rotation of the outer cover 12 during a collision. Each lug 24 is below a respective spacing element 20, and this prevents the removal of the outer cover 12, once the lugs 24 are in position. The position of a hole 22 (and therefore a lug 24) below a respective spacing element 20 also allows the outer cover 12 to move upwards in a collision, to further disperse energy from that collision. So, although the lugs 24 prevent the full removal of the outer cover 12, they do not stop the outer cover rising upwards during a collision.

Figure 3:
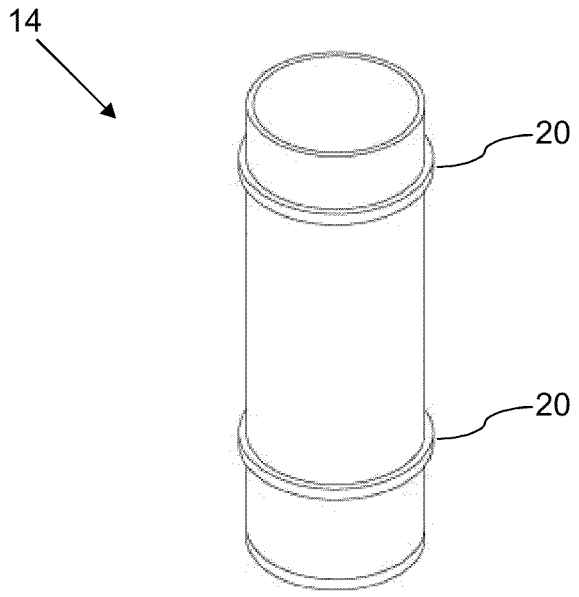
FIG. 3 is a perspective view of an inner core of the bollard.

FIG. 3 shows a perspective view of the inner core 14 of the bollard 10 in an upright position as it would be in use in the bollard 10. The two spacing elements 20 can be seen on the exterior of the inner core 14, one of which is towards the upper end of the inner core 14 and the other of which is towards the lower end of the inner core 14. These spacing elements 20 provide the dual purpose of creating spacing between the inner core 14 and the outer cover 12 when the bollard is in use and providing shock absorption in the event of a collision.

Figure 4:
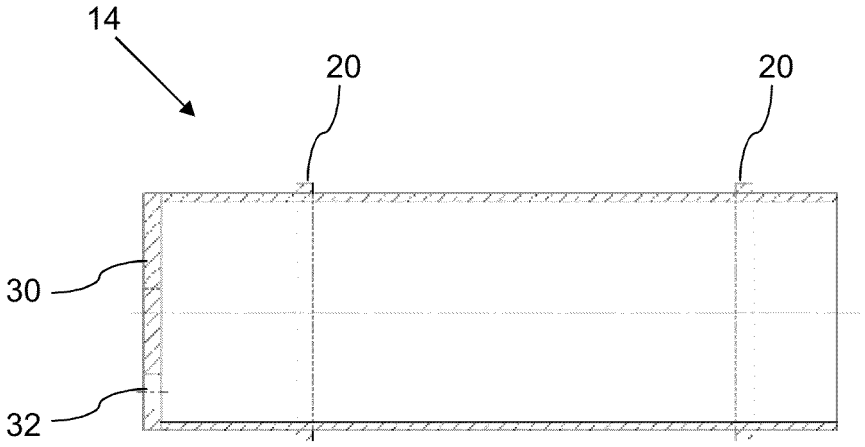
FIG. 4 is a vertical section through the inner core of FIG. 3.

A vertical section through the inner core 14 is shown in FIG. 4, which shows again the position of the spacing elements 20. At the lower end 30, the inner core 14 is closed, so that the essential form of the inner core 14 is a circular cross-section elongate tube that is closed at one end. The closed end 30 is provided with three holes 32 to receive the bolts 26, when the bollard 10 is constructed in position. The inner core 14 is manufactured from a steel tube with a circular steel plate 30 used to close the one end of the inner core 14. Holes are drilled into steel plate 30.

As discussed above, the inner core 14 of the bollard 10 is ground-contacting, with the lower end 30 lying horizontally on the ground 28, with the elongate tubular part of the inner core 14 extending upwards in a vertical direction, as shown in FIG. 3. The bolts 26 fasten the inner core 14 in place, passing through the washer 18 and damper 16 and then through the holes 32 in the base plate 30 that forms the lower end of the inner core 14. The bolts 26 are anchoring the inner core 15 tightly to the ground 28 and ensure that the inner core 14 is fixed in a rigid upright position.

Figure 5:
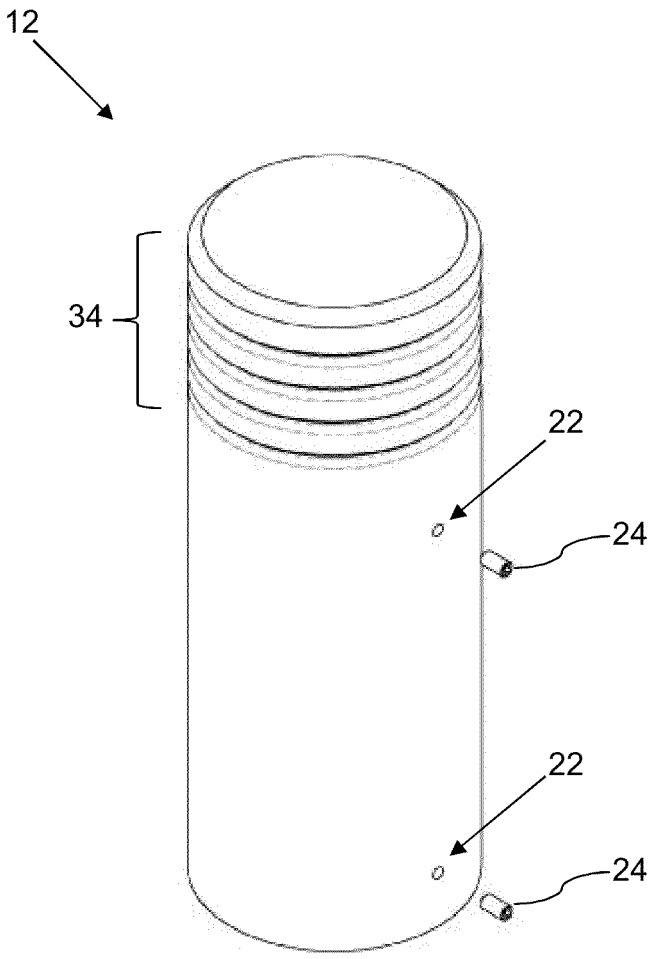
FIG. 5 is a perspective view of an outer cover of the bollard.

The outer cover 12 is shown in a perspective view from above in FIG. 5. The outer cover 12 forms the exterior of the bollard 10 and any collision with the bollard 10 will be directly onto the outer cover 12. As discussed above, the outer cover 12 sits directly on the ground 28 and is not actually connected to any other part of the bollard 10 or indeed to the ground 28. The outer cover 12 is free to rotate during a collision in order to dissipate as much as energy as possible, without causing damage to any of the components of the bollard 10 or to the ground 28.

As can be seen in this Figure, the outer cover 12 is provided with holes 22 that lie on the same vertical line. These holes 22 are located so that they are underneath respective spacing elements 20 on the exterior of the inner core 14, when the bollard 10 is assembled in position. The lugs 24 fit into the holes 22 and can be screwed in so that they are flush with the outer surface of the outer cover 12 and will be so positioned that they extend under the respective spacing element 20. This will prevent unauthorised removal of the outer cover 12 as the lugs 24 will retain the outer cover 12 under the spacing elements 20.

The essential form of the outer cover 12 is a circular cross-section elongate tube that is closed at one end. It is constructed of robust plastics material that will not dent or easily be deformed. The outer cover 12 is a moulding which can be coloured to ensure that is visually stands out as much as possible. At the upper end of the outer cover 12 is a grooved section 34.

Figure 6:
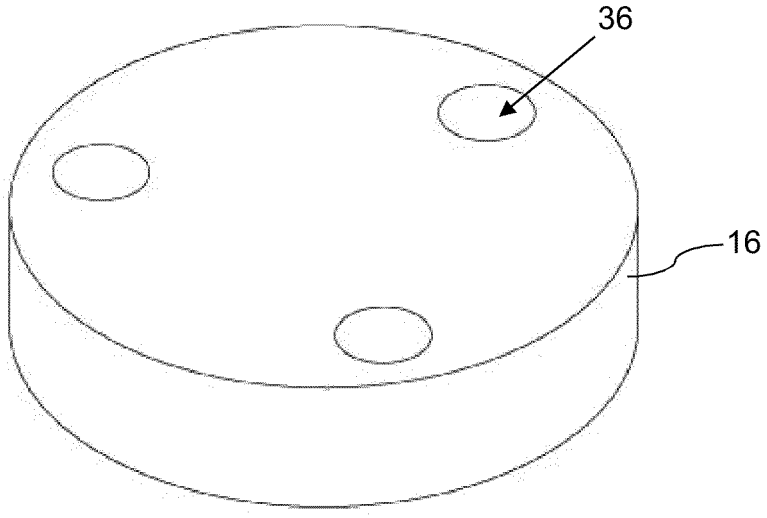
FIG. 6 is a perspective view of a damper of the bollard.

The damper 16 is shown in FIG. 6, which shows a perspective view of the damper 16. The damper 16 is provided with three holes 36 that receive the bolts 26 that are used to hold the damper 16 in position. The damper is made from rubber or some other suitable deformable plastics material that will absorb and disperse as much as possible of the energy of any collision with the bollard 10. The damper 16 is held tightly against the inner core 14 by the washer 18 and the collision energy travels from the outer cover 12 to the inner core 14 to the damper 16, which disperses the energy of the collision.

Figure 7:
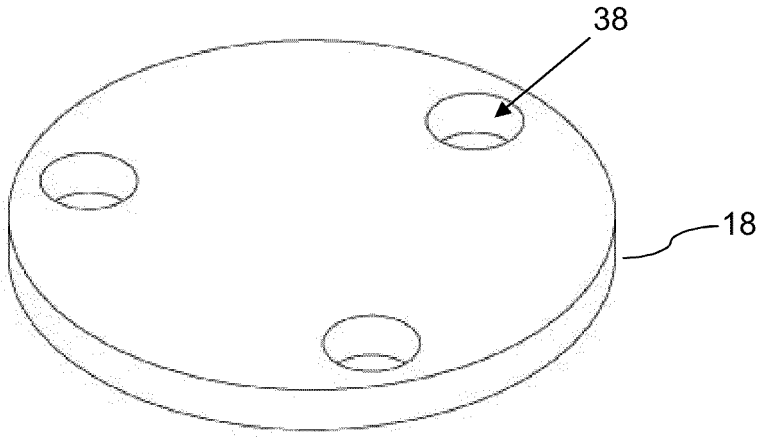
FIG. 7 is a perspective view of a washer of the bollard.

The washer 18 is shown in perspective view from above in FIG. 7. The steel washer 18 is provided with three holes 38 that receive the bolts 26 that are used to hold the washer 18 in position. The washer 18 presses down on the damper 16 as the bolts 26 are tightened to retain the inner core 14 against the ground 28. This ensures that the inner core 14, the damper 16 and the washer 18 are all tightly pressed together and held in position once the bollard 10 is assembled. This will mean that in the event of a collision, the energy of the collision will reach the damper 16, which disperses as much of the energy as possible.

The bollard 10 has a very simple construction and is very easy to assemble. The damper 16 and the washer 18 both have a circumference that matches the interior shape of the inner core 14 and are placed in the bottom of the inner core 14. The inner core 14 can be placed onto the ground 28 and retained in place using the bolts 26. The outer cover 12 is then placed over the inner core 14 and the lugs 24 are screwed into the holes 22 as far as possible in order to prevent the unauthorised removal of the outer cover 12. In this way, the bollard 10 is assembled in position.

The invention claimed is:

1. A bollard comprising an elongate outer tubular cover, an elongate inner tubular core located within the outer tubular cover, a damper located at a lower end of the inner tubular core, a washer arranged to locate the damper against the inner tubular core, one or more spacing elements disposed on an external surface of the elongate inner tubular core, and one or more fixing lugs extending through the outer tubular cover, wherein the outer tubular cover and the inner tubular core are both substantially circular in horizontal cross-section, the outer tubular cover is able to rotate relative to the inner tubular core, and the outer tubular cover is movable along an axial length of the elongate inner tubular core between a first position with the one or more fixing lugs disengaged from the one or more spacing elements and a second position with the one or more fixing lugs engaged with the one or more spacing elements such that removal of the outer tubular cover from the elongate inner tubular core is prevented.

2. A bollard according to claim 1, wherein the outer tubular cover and the inner tubular core are not connected together.

3. A bollard according to claim 1, wherein the outer tubular cover and the inner tubular core are both ground-contacting.

4. A bollard according to claim 1, wherein the washer directly contacts the damper.

5. A bollard according to claim 1, wherein the inner tubular core is closed at the lower end.

6. A bollard according to claim 5, wherein the damper directly contacts the closed lower end of the inner tubular core.

7. A bollard according to claim 1, wherein each spacing element of the one or more spacing elements comprises a substantially horizontal ring around the inner tubular core.

8. A bollard according to claim 1, wherein the inner tubular core comprises two spacing elements on the external surface thereof.

9. A bollard according to claim 1, wherein the outer tubular cover comprises one or more holes, each of the one or more holes having a fixing lug extending therethough.

10. A bollard according to claim 9, wherein at least one hole is located below a spacing element and the respective fixing lug extends inside the outer tubular cover in a position below the spacing element.

11. A bollard according to claim 1, and further comprising one or more bolts, the or each bolt passing through the washer, damper and inner tubular core and into the ground.

12. A method of fixing a bollard to the ground comprising receiving an elongate outer tubular cover, an elongate inner tubular core, a damper, a washer one or more bolts, and one or more fixing lugs, passing each bolt through the washer, damper and inner tubular core and into the ground, placing the outer tubular cover over the inner tubular core such that the outer tubular cover is able to rotate relative to the inner tubular core, and passing the one or more fixing lugs though the elongate outer tubular cover such that the outer tubular cover is movable along an axial length of the elongate inner tubular core between a first position with the one or more fixing lugs disengaged from one or more spacing elements disposed on the elongate inner tubular core and a second position with the one or more fixing lugs engaged with the one or more spacing elements such that removal of the outer tubular cover from the elongate inner tubular core is prevented.

13. The method of claim 12 further comprising rotatably positioning the outer tubular cover on the inner tubular core.

14. A method according to claim 12, wherein the outer tubular cover and the inner tubular core are not connected together.

15. A method according to claim 12, wherein the outer tubular cover and the inner tubular core are both ground-contacting.

16. A method according to claim 12, wherein the washer directly contacts the damper.

17. A method according to claim 12, wherein the inner tubular core is closed at the lower end and the damper directly contacts the closed lower end of the inner tubular core.

18. A method according to claim 12, wherein the outer tubular cover comprising one or more holes, each hole locating a fixing lug of the one or more fixing lugs.

19. A method according to claim 18, wherein at least one hole is located below a spacing element of the one or more spacing elements on the external surface of the inner tubular core and the respective fixing lug extends inside the outer tubular cover in a position below the spacing element.

20. A method according to claim 19, wherein each spacing element of the one or more spacing elements comprises a substantially horizontal ring around the inner tubular core.

21. A method according to claim 19, wherein the inner tubular core comprises two spacing elements on the external surface thereof.

22. The bollard of claim 1 wherein the outer tubular cover is rotatably positioned on the inner tubular core.

* * * * *